US005941117A

United States Patent [19]

Butcher et al.

[11] Patent Number: 5,941,117

[45] Date of Patent: Aug. 24, 1999

[54] DIE TOOL THERMAL CONTROL AND TOOLING OPTIMIZATION APPARATUS AND METHOD

[75] Inventors: Gregory H. Butcher, Lima; Neil Zumberger; Shu An, both of Sidney, all of Ohio

[73] Assignee: Aluminum Company of America, Pittsburgh, Pa.

[21] Appl. No.: 09/070,709

[22] Filed: Apr. 30, 1998

[51] Int. Cl.[6] ..... B21D 37/16

[52] U.S. Cl. ..... 72/342.7; 72/348; 413/17

[58] Field of Search ..... 72/20.1, 31.01, 72/342.3, 342.7, 342.8, 342.92, 348; 413/17

[56] References Cited

U.S. PATENT DOCUMENTS

| | | | |
|---|---|---|---|
| 4,408,471 | 10/1983 | Gossard et al. | 72/21 |
| 4,610,156 | 9/1986 | Kaminski et al. | 72/431 |
| 4,692,857 | 9/1987 | Chi | 364/184 |
| 4,945,742 | 8/1990 | Schoch | 72/21 |
| 5,027,631 | 7/1991 | Naito | 72/19 |
| 5,271,254 | 12/1993 | Gloe et al. | 72/19 |
| 5,277,047 | 1/1994 | Herdzina | 72/342.92 |
| 5,423,199 | 6/1995 | Mangrulkar | 72/3 |
| 5,564,298 | 10/1996 | DeMeo | 72/19.8 |

FOREIGN PATENT DOCUMENTS

| | | | |
|---|---|---|---|
| 303647 | 12/1990 | Japan | 72/342.7 |
| 212485 | 8/1993 | Japan | 72/342.7 |

*Primary Examiner*—Joseph J. Hail, III
*Assistant Examiner*—Susan R. Kingsbury
*Attorney, Agent, or Firm*—Thomas R. Trempus

[57] ABSTRACT

A die tool monitor and analysis system identifies tooling changes and maintains tooling in an optimal position, thus maintaining the quality of the manufactured product within a desired tolerance band. A die tool force monitor and analysis system identifies changes in the operational conditions within a press. These identified changes are indicative of tooling changes and in conjunction with a thermal control system, facilitate the thermally induced expansion and contraction of a tooling support structure. The expansion and contraction of the supporting structure displaces the tooling member relative to its counterpart tooling member.

25 Claims, 6 Drawing Sheets

DIE TOOL THERMAL CONTROL AND TOOLING OPTIMIZATION APPARATUS AND METHOD

FIELD OF THE INVENTION

The invention generally relates to the manufacture of can ends, specifically aluminum can ends of the type which are employed in the packaging in which beer and beverages as well as other food products are distributed and sold. More particularly, the invention provides a thermal control apparatus that cooperates with a thermal monitoring and a force monitoring and analysis system for use in a conversion press. The invention identifies changes in the forces being applied to the tooling and adjusts the position of tooling.

BACKGROUND OF THE INVENTION

Many metallic cans for holding beverages or other products are provided with easy-open can ends, wherein a pull tab attached to a tear strip that is defined by a score line in the can end may be pulled to provide an opening in the can end for dispensing the can's contents. Likewise, many food products are sold in metal containers that have ends designed to facilitate access to the contents without the use of can openers or the like.

By way of example, in the manufacture of an easy-open can end, a can end shell is first formed from a metal sheet product, preferably an aluminum sheet product. The can end shell is then conveyed to a conversion press. In the typical operation of a conversion press, a can end shell is introduced between an upper tool member and a lower tool member which are in the open, spaced apart position. A press ram advances the upper tool member toward the lower tool member in order to perform any of a variety of tooling operations such as rivet forming, paneling, scoring, embossing, tab securing, and final staking. After performing a tooling operation, the press ram retracts until the upper tool member and lower tool member are once again in the open, spaced apart position. The partially converted shell is transported to the next successive tooling operation until an easy-open can end is completely formed and discharged from the press. As one shell leaves a given tooling station or forming operation, another shell is introduced into or indexed into the vacated station, thus continuously repeating the entire easy-open can end manufacturing process. Conversion presses can operate at speeds that produce in excess of 500 can ends per minute per lane, with some machines having 4 lanes producing 2000 ends per minute. It has been the practice in the can end industry to continue to strive to reduce the gauge of the metal of the can end. The current practice is to use metal with a gauge of approximately 0.008 inch. While it should by readily apparent that each of the several tooling stations must be rigorously maintained within prescribed operating tolerances, of critical concern in the production of the converted end is the scoring station. The scoring station of the conversion press employs a knife edge tooling member that defines the panel opening in the face of the can end. The tooling for the scoring is subject to wear and converted can ends must be periodically examined to ensure that the score formed in the panel is within a predetermined tolerance that defines both the depth of the score line and the amount of residual metal below the score. If tolerances are not maintained, the converted end may either fail to open properly or simply fail prematurely during shipping and handling of the filled container. As can be appreciated, the very nature of can end formation requires a nearly continuous monitoring and adjustment of the output of the press in order to maintain product quality and avoid changes in residual, rivet head thickness, or rivet diameter that result in poor quality products.

U.S. Pat. No. 5,564,298, entitled "Die Tool and Press Monitor and Product Quality Analysis Apparatus and Method" to DeMeo which is assigned to the assignee of the instant invention, and is incorporated herein by reference as if fully set forth, discloses a die tool wear monitor. More particularly, this patent discloses the value of monitoring the force proximate die tooling stations that is generated during the approach of the upper ram toward the lower tooling and the withdrawal of the upper ram from the lower tooling.

It remains a goal of the conversion press industry to continue to strive toward the manufacture of can ends of both reduced diameter and reduced metal thickness in order to effect enhanced cost savings through the use of less metal in each packaged product. Likewise, it is another goal of the industry to maintain product quality at the highest rates of press operation and to minimize the loss of product due to the failure to quickly identify and compensate for normal changes in tooling height.

It is therefore an object of this invention to provide a conversion die tooling adjustment apparatus and method for maintaining product quality.

It is yet another object of this invention to provide a method and apparatus to compensate for changes in tooling height and adjust the individual tooling members during their normal cycle so that the product produced thereby is optimized.

It is yet another object of this invention to provide a method and an apparatus that reduces the need for periodic physical inspections of the converted can ends through the thermal control of tooling stations.

It is an object of this invention to establish an ideal thermal condition for a given tooling station and to provide an apparatus and method for monitoring and maintaining the thermal condition of the given tooling station throughout conversion press start-up and operation.

SUMMARY OF THE INVENTION

The combination of the die tool adjustment apparatus and method and the product quality monitoring system of this invention is employed in a convention press for the manufacturer of can ends. In a conversion press, a reciprocating ram advances and retracts a first member having a first tooling component toward and away from a second member having a second tooling component. Typically, the second tooling component is mounted on a stationary tooling bed. The die tool monitor and adjustment system provides a method for the identification of changes in the tooling forces and the resulting variations in the quality of the conversion press product as it is indexed through the various tooling stations within the conversion process. Additionally, the invention includes an apparatus for the adjustment of the tooling position through thermally induced expansion and contraction of tooling support members.

According to the method of this invention, a first signal indicative of the angular position of the reciprocating ram through a predetermined range of travel is generated. Zero degrees indicates that the furthest withdrawal of the ram from the press bed and 180 degrees indicates the closest point of approach of the ram to the press bed. A second signal indicative of the force differential present between the first tooling component and the second tooling component is generated. The second signal is plotted relative to the first signal that identifies the position of the reciprocating ram in order to define a value of force differential for each selected position of the upper and lower tooling relative to each other. A third signal is generated by a thermocouple associated with the apparatus for the adjustment of the tooling position through thermally induced expansion and contraction. A central processing unit computes the sum under the wave of output signals generated by the first and second signal, identifying potential changes in product. If such conditions are identified as existing, thermal modification of the tooling support member is initiated and maintained until the monitored force indicates that acceptable conditions have been re-established in the monitored tooling.

The application of the invention permits the adjustment of the score residual using thermo growth of the die, thus fewer adjustments to the tooling will be required. For example, once the product reaches the desired residual, the sum under the wave becomes the target value and the loop is closed. The die may continue to grow or shrink as the die reaches thermo equilibrium. The processor uses the sum under the wave to adjust the temperature of the tooling support members during this period, holding the product within tighter tolerances. As the environment changes around the press, changing the residual, the processor will direct the adjustment of the die height dynamically, thus holding the product within tighter tolerances.

Of particular significance to the commercial operator of the press is the reduction of the number of progressions pulled to examine the product at each stage (or lane) of its production. Under current operating standards, progressions are pulled and tested every six hours to determine if the product is within specifications. Thus, the sum under the waves processed according to this invention will not only adjust the die height but may also indicate that the product is within production specifications. The force monitoring and thermo growth features of this invention may be incorporated into the various tooling stations. For example, each of the several stages of the rivet formation process can be monitored without stopping the press. Additionally, when installing a new die fine adjustments can be made using thermo growth.

This invention monitors tooling components directly and manufactured products indirectly at critical stages of a conversion process. In addition to monitoring the conversion process, the conversion press is stopped if the analysis indicates that continued operation could cause serious die or press damage or if process goes out of production limits.

BRIEF DESCRIPTION OF THE DRAWINGS

The above as well as other features and advantages of the invention can be appreciated through consideration of the detailed description in conjunction with the following figures in which.

DETAILED DESCRIPTION OF THE INVENTION

Figure 1:
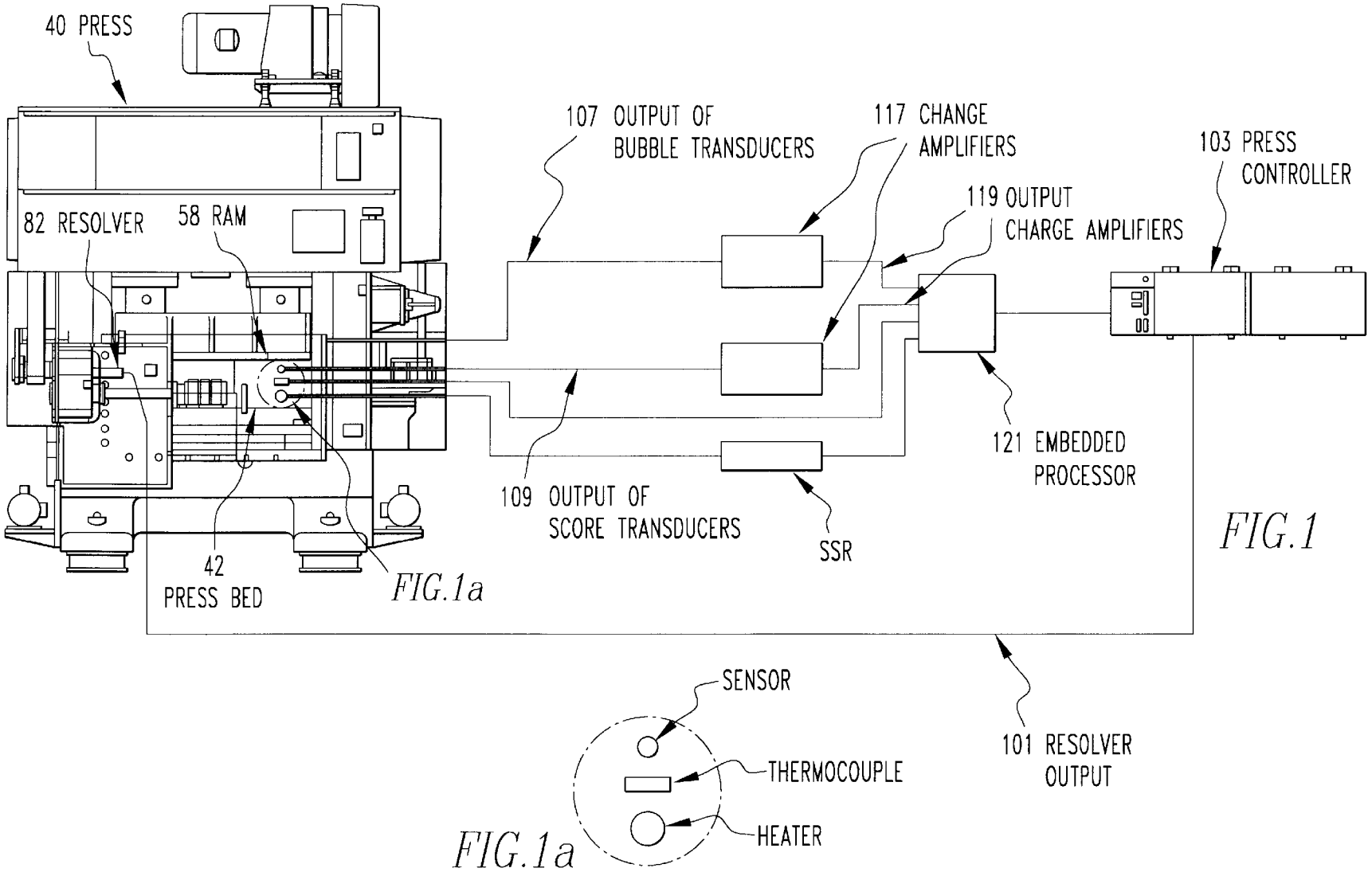
FIG. 1 is a schematic drawing of the die tool analysis and thermal adjustment systems of this invention.
Figure 2:
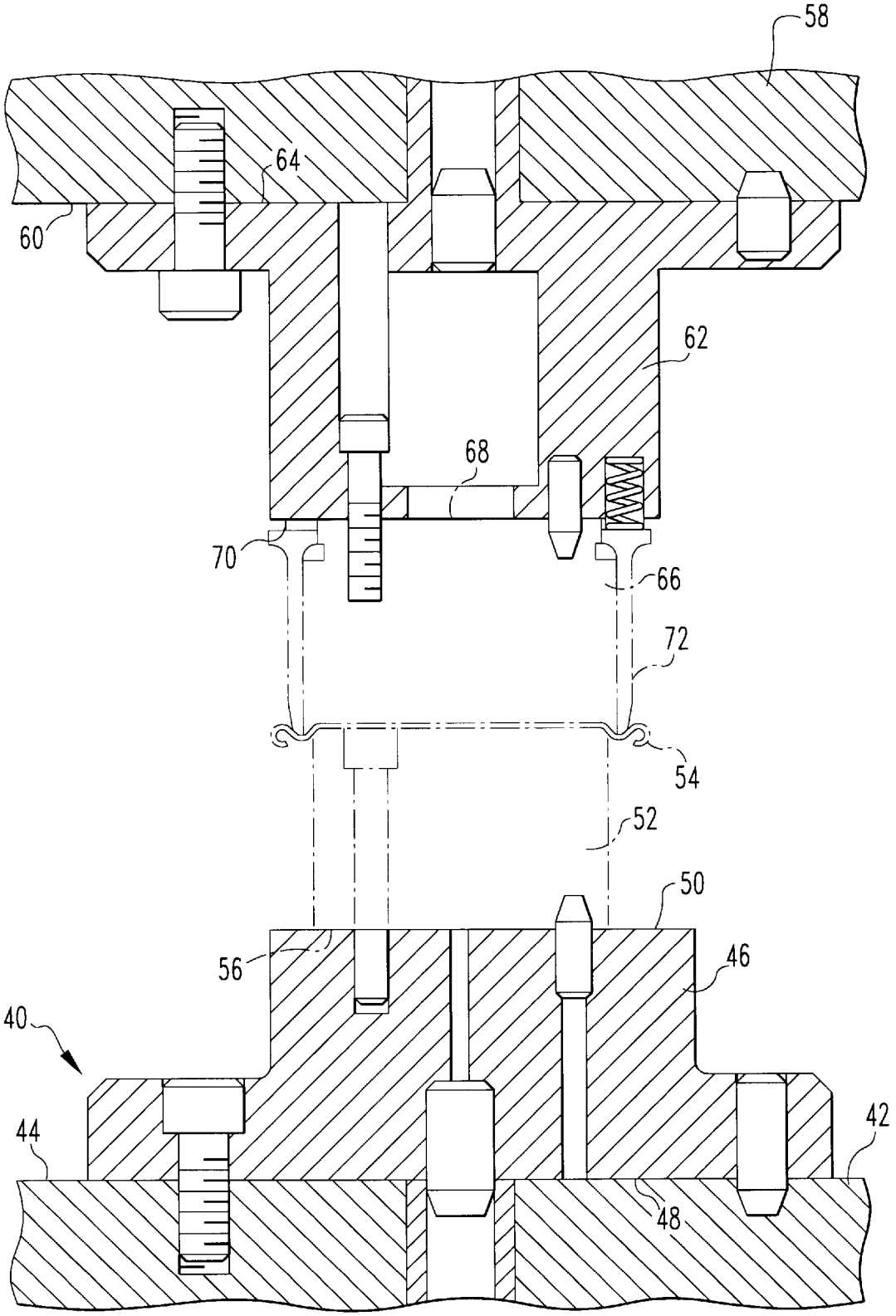
FIG. 2 is a cross sectional side view illustrating a conventional prior art press ram, tool support means, ram, upper and lower tool members, a support base and a stationary press bed.

Turning to FIG. 1, a can end conversion press for the manufacturer of can ends or the like in which the apparatus and method of the present invention are incorporated is generally indicated by the reference character 40. While the invention is described in connection with an easy-open-can-end conversion press, it is to be understood that the apparatus and method of this invention can be applied to a press employed in the production of other articles of manufacture. The Minster Machine Company of Minster, Ohio, manufactures and sells an industrial press suitable for configuration as a can end conversion press. The manufacture of a can end shell into an easy-open can end takes place in a conversion press, a conventional portion of which is shown in FIG. 2. (The integration of the thermal control apparatus of this invention is described in conjunction with FIG. 3.) The conversion press 40 generally includes a stationary press bed 42 that has a generally planar horizontal upper surface 44. The upper surface supports a tooling base 46 which has a planar bottom surface 48 and a planar upper surface 50. Positioned upon the upper surface of tooling base is a lower tooling member 52 (shown in phantom) which may take a variety of shapes depending upon the tooling operation to be performed on the can end shell 54. However, each lower tooling member 52 has a planar bottom surface 56 which mates with the upper surface 50 of the tooling base 46 to provide secure support for the lower tooling member 52.

A vertically displaceable press ram 58 overlies press bed and includes a generally planar horizontal lower surface 60. This surface 60 of the press ram 58 supports a tool support means 62 which may take a plurality of shapes depending upon the type selected for a particular tooling operation. In general, however, the tooling support means or base 62 includes an upper planar surface 64 which provides solid mating contact with the surface 60 of the press ram 58 so that the tooling support means 62 is securely fastened to the press ram. The tool support means 62 securely supports an upper tooling member (shown in phantom) 66 having an upper planar surface 68 that is in mating contact with the lower planar surface 70 of the tool support means 62. The upper tooling member 66 can be one of many shapes and sizes depending upon the particular tooling operation to be performed. Typically, a centering ring 72 locates the can end shell 54 in each tooling station.

The can end shell is introduced between an upper tool member and a lower tool member which are in the open spaced apart position. The press ram 58 advances the upper tool member toward the lower tool member in order to perform any of a variety of tooling operations such as rivet forming, paneling, scoring, embossing, tab securing and final staking. Additionally, separate tooling is typically provided that works in conjunction with the main conversion tooling described above to produce the tab that is staked onto an integral rivet formed in the can end. After performing a tooling operation, the press ram 58 retracts from the lower press bed 42 until the upper tool member and lower tool member are once again in the open, spaced apart position. The partially converted shell 54 is transported to the next following tooling operation whereupon the press ram advances the upper tooling member toward the lower tooling member. This operation of advancing and retreating the upper tooling member and sequentially advancing the converted shell from one tooling station to the next successive tooling station continues until an easy open end is completely formed and discharged from the press. The conversion press 40 includes a variety of belt driven components which index the converted can ends through the tooling stations. The indexing of parts is coordinated with the reciprocating movement of the ram press. A conventional resolver 82 (FIG. 1) is in communication with the ram press so as to generate a signal indicative of the angular location of the press ram 58 as it advances and retreats toward and away from the press bed 42. In its highest position or the position furthest from the press bed, the angular position of the ram is zero (000 degrees) and the output of the resolver indicates the same. When the ram advances and is in its lowest position, closest to the press bed, the ram is at the 180 degrees position of its travel.

Generally, the complete manufacturing process for the conversion of a can shell into a converted can end takes place in eight successive tooling stations. It is known to produce a converted can end in less than eight stations and it is no doubt possible to use more than eight stations depending of course upon the specific features to be incorporated into the can end. The tooling stations are arranged in lanes and a belt advances the can end shell through each tooling station in a particular lane. The assignee of the present invention designs and manufactures conversion presses that have either two lanes, three lanes, or four lanes of tooling. By way of example, a single conversion press with three lanes of tooling can produce approximately 1800 fully converted can ends in one minute. At this rate of production, a conversion press with tooling die irregularities could produce 100,000 defective can ends, i.e., scrap metal, in a single hour of substandard operation. A more complete understanding of the operation of a conversion press is available by a review of U.S. Pat. No. 4,610,156, "Progressive Die Apparatus Having Resilient Tool Support Means", which is assigned to the assignee of the instant invention and which is incorporated herein by reference as if fully set forth.

Figure 3:
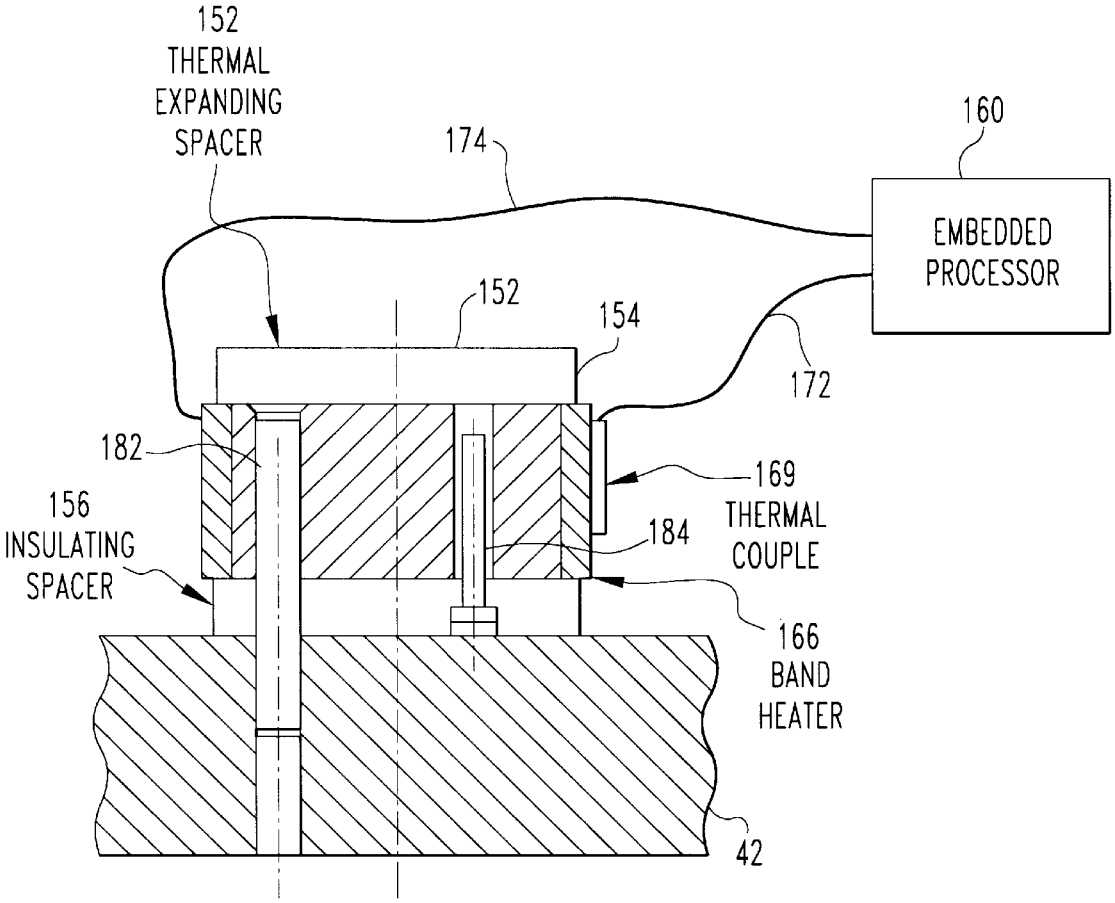
FIG. 3 is a cross sectional side view illustrating the thermal control elements of a lower tooling station.

Turning to FIG. 3 there is shown in a schematic, side elevation of a lower tooling station, the thermal control system of this invention. In comparing the apparatus of this invention to the conventional station of FIG. 2, tooling base 46 (FIG. 2) is replaced by at least spacers 152 and 156. The integration of the concept of thermal expansion into the tooling support structure makes possible the adjustment of the tooling position within the die set. When the lower station support member is heated up sufficiently to cause thermal expansion, the position of the lower cap 52 will be elevated relative to the stationary bed. This elevation occurs in an incremental fashion. As can be appreciated to those skilled in the art, a displacement of as little as 0.0001 inch may be all that is required to maintain the tooling in an optimal relationship during manufacturing operations. As a result of such apparently minor displacement of the lower tooling member through thermally induced expansion and contraction of the tooling support member, specifically, the steel spacer 152, the residual of the score on the can ends can be adjusted. We have found that the total adjustment available through thermal control is approximately 0.0005 inches.

The steel thermal expanding spacer 152 is disposed with at least one insulating spacer, as at 156. Alternatively, an upper and lower insulating spacers may be used with the expanding spacer 152. The upper spacer would be positioned as at 154, between the tooling 52 and the expanding spacer 152. We believe that in certain tooling applications, such as in the rivet formation tooling, an upper insulating spacer may prove useful. The score station will only have one insulating spacer, preferably the spacer 156 will probably be placed just above the press bed 42. The press bed 42 has an upper planar surface 48 on which the insulating spacer 156 is seated. Alignment pins such as 182 and 184 establish and retain the axial position of the several assembled pieces. A heater means such as a band heater 166 is circumferentially disposed about the thermal expanding spacer 152. A thermocouple 168 is in communication with the spacer 152 and is in electrical communication with a temperature control system 160 by means of leads 172 and 174. By monitoring the temperature of the steel spacer 152, and in conjunction with the data generated by monitoring the force output of the press, optimal conditions for establishing and maintaining the quality of the product out-put are defined. Thus, the relationship between the temperature of the spacer 152 and the relationship of the tooling members when the press is at the 180 degree position can be established and an ideal relationship maintained. With adjustment of the steel spacer 152 by thermally induced expansion or contraction, the position of the lower tooling member is adjusted in order to maintain the overall relationship between the upper and lower tooling member. The heater 166 is cycled on and off based on feedback from a thermocouple 168 and input from a force measuring system that is described below.

Figure 4:
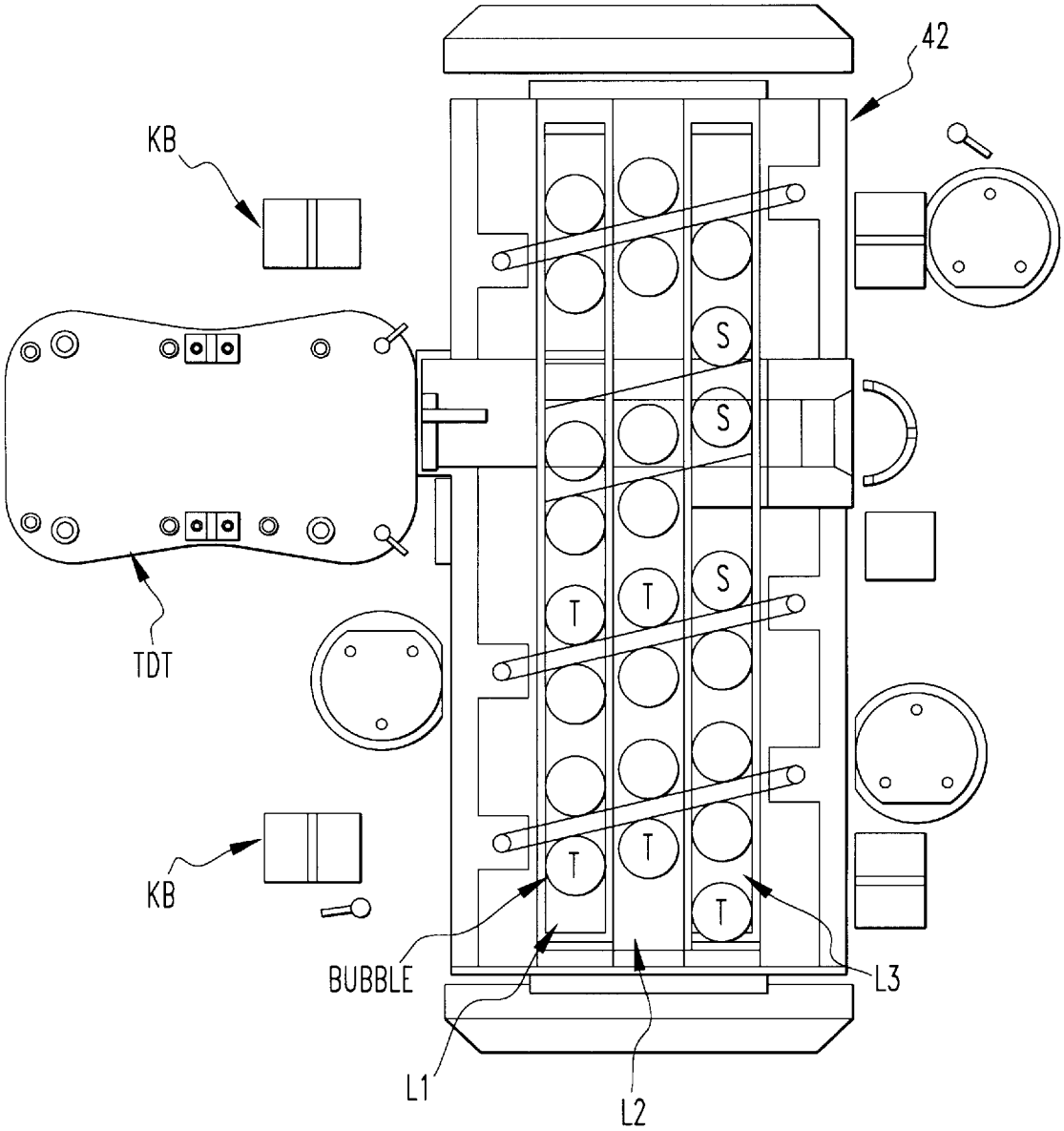
FIG. 4 is a schematic drawing of a typical die tool bed layout illustrating the several tooling stations in the conversion press and preferred locations for the force measurement and signal generating transducer means.

A schematic representation of the stationary die tool bed 42 is shown in FIG. 4. This embodiment of the tool die bed 42 includes three lanes of tooling, L1, L2, and L3, each of which consists of eight separate tooling stations schematically indicated by the circular members, some of which are designated "S". In a conversion press, a second set of tooling manufactures the tab that is operated by the consumer to open the can end. This second set of tooling is the tab die tooling, "TDT" and typically consists of three lanes of tooling each having multiple stations in which the tab is formed from a continuous strip of metal. As previously mentioned, the tool die bed may have only one lane or at present, up to four lanes.

Several force transducers are located in critical tooling stations of the conversion process. These transducers are indicated by the reference character "T". It has been found that quartz crystal transducers are particularly well suited for this application. Quartz force transducers measure dynamic and quasi static forces from a few N up to 1.2 MN. Suitable force transducers for use in accordance with the instant invention are commercially available from Kistler Instrument Corporation, Amherst, N.Y. While it is to be appreciated that the force transducers "T" can be located in any number of locations in the press bed such as shown in FIG. 4, at a minimum, force transducers are preferably located proximate the scoring tooling station. Three transducers "T" are situated proximate the bubble formation tooling station, three transducers are proximate the scoring tooling station. The techniques employed in the mounting of a force transducer are known to those skilled in the application of them and is only briefly mentioned herein. Generally, to mount a transducer, a seat is milled or formed in the desired location. Suitable channels or bores are also provided to permit the electrical connection of the transducer. The transducer is placed in the seat and the electrical leads exit the tooling bed by means of the channel or bore.

Two output signals from the conversion press are monitored along with the output of the Thermocouple 168, a third signal, which will be described separately below. The first signal, as described above, is from the conversion press resolver and indicates the angular position of the press ram, and as a result, the relative distance between the tooling die halves can be calculated. The resolver output 101 is typically monitored by the standard press controller 103. The press controller 103 communicates operator instructions, such as the warm up, initiation, and termination of press operations, to the press drive system. The second signal is in fact the several individual outputs that are generated by the force transducers "T" disposed in the tooling plate, and conversion press bed kiss blocks KB. The outputs of the three transducers "T" situated proximate the bubble formation tooling station are indicated at 107 and the outputs of the three transducers proximate the scoring tooling station are indicated at 109, Each of the quartz force transducers "T" generates an electrical output indicative of the dynamic force and quasistatic force present as the press ram advances and retreats relative to the die tool bed. The transducers generate eight separate outputs, i.e., 107 and 109 that are transmitted to charge amplifiers generally indicated by the reference character 117. The output 119 of each of the charge amplifiers is processed by an embedded processor 121. The embedded processor 121 receives the press operational and control information and then compares it with programmed die information as described elsewhere herein. Additionally, in the event that press operations are not within a predefined range of acceptable variances the press controller will stop the process and provide an appropriate message to alert the operator.

Figure 6:
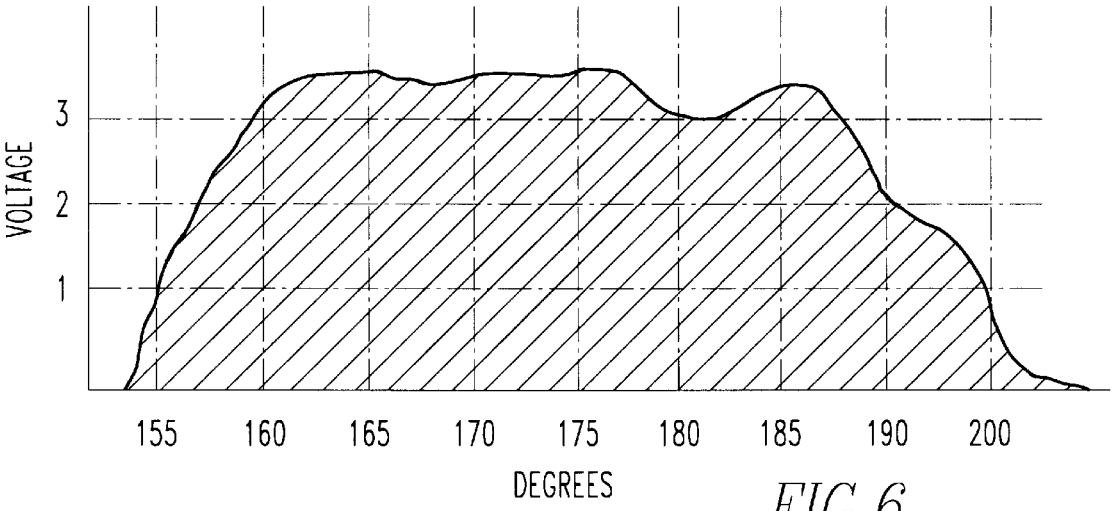
FIG. 6 is a graph representing the output of the force measurement and signal generating transducer means.

The sampling of the output of each force transducer means "T" is initiated when the angular position of the press ram is at 155 degrees in its advance toward the stationary bed. The sampling is terminated when the press ram retreats to an angular position of 205 degrees relative to the press bed. In this arrangement, for each degree of travel of the press between the range of 155 degrees and 205 degrees, the output of each of the force transducers is monitored. This preferred arrangement provides 25 individual signal samples from each sensor during the down stroke and 25 signal samples from each sensor during the return stroke. With the use of 8 transducers, a total of 400 data points can be generated during a single stroke of the press. As individual tooling components in the die tool bed begin to wear or experience any misalignment, the resulting change to the tooling creates a difference in the overall measurable force detected by the transducers. This change in the force generated in the tooling is reflected in the output of the force transducer at various angular locations of the press ram. We have discovered that while monitoring the output during the 50 degrees of travel described above, as press speed changes, i.e., strokes per minute, the wave form generated by the output changes. Moreover, we have found that in considering peak signal outputs during this 50 degrees of monitoring, the correlation between output signal and wear is not completely reliable. However, we have found that by calculating the area under the wave a more reliable indication of tooling condition is established. The area equals a determinable tooling relationship for a given speed. By collecting data during the operation of the press for a given material being processed by the press at a given speed of the press, data will indicate the appropriate relationship between the tooling members. An example of this is shown in the graph of FIG. 6, representing the output of the force measurement and signal generating transducer means. Thus through experimental determination, including the empirical determination of when a good product is being produced by the press under a set of identifiable conditions, e.g., material, speed, and temperature, the established wave form of the output signals is reviewed and the area defined by that wave form calculated. We believe that for a defined value in an established relationship that gives an acceptable product, a percent change in that defined value will indicate a need to adjust the tooling. The need for tooling adjustment is addressed by means of the thermally induced displacement of the tooling support structure. Accordingly, the desired product quality of the product is maintained. With the method and apparatus of this invention, when a product is defined to have good characteristics such as, for example, pop values, push values, and anti-missile values in a converted can end, the area under the wave for that product is calculated and serves as a baseline for product to be manufactured in that press.

It should be appreciated that at each work station associated with a force transducer, the transducer produces a signal indicative of the force present at that work station. This measure of force over time gives an indication of the work being done at that station. Each station may have one or more work operations performed on the can end shell. Typically several operations are being performed on the can end at each station. For example, the tab or ear wipe station may also include incising in which recycling information or manufacturing information is also incised onto the can end panel.

Figure 5:
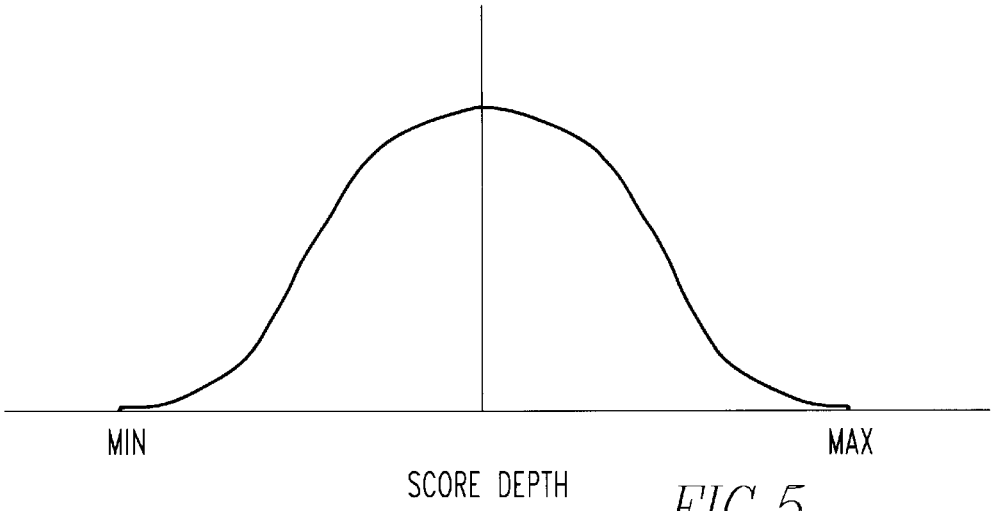
FIG. 5 is a graph representing tool load parameters.

Turning now to FIG. 5, an example of the acceptable tolerances of a single feature, such as the converted can end's score residual is graphically represented. The score is the cut that is made in the panel of the can end. Details of the features in a converted can end are available in U.S. Pat. No. 5,563,700, entitled, "Method and Apparatus for Testing the Material Integrity of a Converted Can End," which is assigned to the assignee of the instant invention and the contents of which are incorporated herein by reference as if fully set forth. A typical can end is produced from a shell thickness of 0.0088 gauge metal, usually aluminum, but in some instances, steel. The score is formed by cutting into the surface of the can end. The score has a depth of 0.005 with a tolerance of plus or minus 0.0003 inches. The un-cut portion of the panel below the score line is called the residual, having a thickness of 0.0038 with a tolerance of plus or minus 0.0003 inches. In order to maintain the product within the acceptable range of tolerances, the height of the tooling must be periodically adjusted to compensate for changes in tool height. Heretofore, this adjustment was done manually by a process of shimming the tooling to raise and lower it relative to the stationary mounting structure on which it rested. Each adjustment required a complete halt to product production. To reduce the frequency of adjustments tooling was initially calibrated to produce product with a broad range of the acceptable tolerances, resulting in a reduced percentage of product being "on spec."

Figure 7:
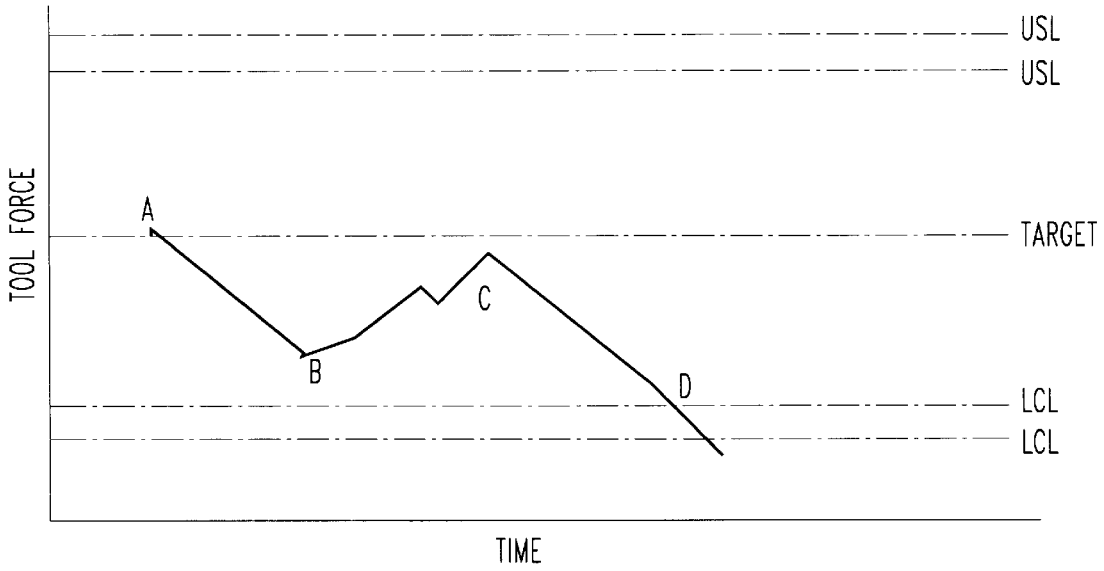
FIG. 7 is a graph illustrating the relationship of the process of this invention to a given set of production limits in the manufacture of an easy-open can end.

As illustrated in the graph of FIG. 7, the relationship of the several steps in the thermal growth process by which tooling force is maintained during press operation is shown as a function of time. In the conversion process, for a given tooling station and corresponding product specification, upper specification limits, USL, and lower specification limits LSL, are established as approximately plus or minus four standard deviations from the target. Within this boundary, upper control limits, UCL, and lower control limits, LCL, are established to represent approximately plus or minus three standard deviations, a total six standard deviations, or 99.73% of the upper and lower specification limits. The difference represents a safety factor as the product drifts away from the predetermined target value. As shown in the graph, the tooling is set at a target value, "A." During operation, as the monitored tool force indicates that the force is drifting away from the target value, at Point "B" thermal growth is initiated in order to expand the tooling toward the target value for measured force. This target value, according to the time line of the graph is indicated at "C." Ultimately, the limit of thermal expansion will be achieved as shown at "C" and the monitored tooling force will drift toward the lower control limit, LCL as at D. The operation of the press is stopped at this point to permit required maintenance of the tooling, such as the replacement of wear parts or the mechanical adjustment of the tooling components.

As tooling wears and the depth of the score begins to move toward the lower (i.e., shallow) end of its tolerance band, we have found that there is a reduction in the level of monitored force because less work in being performed by the press tooling. Obviously, tool length impacts the quality of the product being produced. For example, the tolerance of a score could be ±0.0005 inches. In order to maximize the duration of a particular tooling adjustment, the tooling is set so that it begins to produce product with a maximum score depth that includes the tolerance, i.e., ±0.0005, continues to produce product while wearing to a point where product is produced that is precisely at the specified depth, and then begins to produce product with a score depth that is closer to the minimum depth that is possible, i.e., −0.0005 inches. As is the case under any bell curve analysis, a significant component of the product will be in the ± range of the tolerances established for a given value. By comparison, the present invention permits the installation of the tooling in an ideal spaced relationship for the production of "on-spec" product. The relationship between the data from the force sensors and the height of the die tooling is known, the relationship between the height of the die tooling and the die tooling support structure temperature is known. Therefore, when the data from the force sensors indicates the die tooling is out of position, the height of the die tooling is adjusted through thermal compensation. Accordingly, as the tooling height changes, the tooling position is adjusted to maintain the tooling in this ideal condition, rather than relying on the tolerances that are established as a reflection of the prior art's inability to establish and maintain the preferred relationship.

The press machinery used in a conversion press of the type in which the application of the instant invention is contemplating is a very sophisticated piece of machinery. The press includes its own temperature regulating system to heat and cool the press as necessary during its high speed operation. Typically, from a cool start, it may take from ten minutes to thirty minutes for the press and the tooling in the press to achieve a stable, thermal status that permits product production. Because the instant invention establishes and maintains the tooling within a predetermined temperature range, the need to stabilize the temperature of the tooling by means of the ambient temperature of the press is substantially eliminated. Additionally, through the use of this invention, it is possible to adjust tooling relationship by adjusting the positioning of at least one tooling member. Moreover, through the monitoring of the temperature of the tooling, it is possible to detect likely changes in the tooling relationship. Because the positional relationship of the tooling can be detected, it is possible to stop the press when the tooling relationship exceeds predetermined limits. Now that the quality of the product being produced by the tooling can be indirectly determined by means of the thermal condition of the tooling, the need for frequent interruptions in production in order to test the product is substantially eliminated. While the preferred embodiment of the invention has been described in conjunction with the scoring station, it should be appreciated to those skilled in the art that the method and apparatus of this invention may be employed in other tooling stations requiring adjustments to monitor critical tolerances. By placing multiple independent thermal-controlled stations in critical areas of the press tooling, it is possible to simultaneously monitor and control the positions of each of these several tooling members. Thermal control of the tooling also contributes to a reduction in the need for tool replacement by increasing the usable life of tooling. Moreover, through the ability to identify changes in tool height, excessive wear can be identified and the need for change recognized.

What has been described is a method and an apparatus particularly well suited for the monitoring of die tooling in a conversion press, the adjustment of tooling to compensate for height changes in tooling as identified by tool monitoring, the monitoring of press operations, and monitoring manufactured part quality through the analysis of tooling forces. It is to be appreciated that having described the presently preferred embodiments, it is to be understood that the invention may be otherwise embodied within the scope of the appended claims Having described the invention, what is claimed is:

1. In combination with an apparatus for the manufacture of products in which a first tooling member is advanced toward and retracted away from a second tooling member, which is mounted upon a stationary bed, an apparatus for maintaining said first and second tooling members in a predetermined relationship relative to each other, said apparatus for maintaining comprising:

a. thermal sensitive means disposed between said at least one tooling member and means for supporting said at least one tooling member in the apparatus for the manufacture of products, said thermal sensitive means being capable of thermally induced expansion and contraction, wherein the expansion and contraction of the thermal sensitive means displaces said at least one tooling member relative to said means for supporting said at least one tooling member, b. temperature sensing means in thermal communication with said thermal sensitive means, c. thermal control means in communication with said temperature sensing means and said thermal sensitive means and responsive to said temperature sensing means so as to effect the expansion and contraction of said thermal expansion means whereby said at least one tooling member is displaceable from a first position to a selected second position relative to said means for supporting said at least one tooling member.

2. The combination according to claim 1 wherein the temperature sensing means is a thermal couple that is in electrical communication with said thermal control means and in physical communication with said thermal sensitive means wherein said thermal control means monitors the temperature of the thermal sensitive means and selectively effects the heating of the thermal sensitive means.

3. The combination according to claim 2 wherein the thermal sensitive means comprises a steel thermal expanding spacer in communication with a heater means wherein the generation of heat by said heater means causes said thermal spacer to expand such that the expansion of said thermal spacer displaces at least one tooling member relative to said means for supporting at least one tooling member.

4. The combination according to claim 1 wherein the means for supporting said at least one tooling member includes the stationary bed and wherein the thermal sensitive means is disposed between said at least one tooling member and the stationary bed.

5. The combination according to claim 1 wherein the means for supporting said at least one tooling member includes the stationary bed.

6. The combination according to claim 1 wherein the apparatus for the manufacture of products is a can end conversion press and the products are easy-open can ends.

7. The combination according to claim 1 wherein the apparatus includes at least a third and fourth tooling members.

8. The combination according to claim 7 wherein at least one of the third and fourth tooling members includes thermal sensitive means disposed between said at least one tooling member and means for supporting said at least one tooling member in the apparatus for the manufacture of products, said thermal sensitive means being capable of thermally induced expansion and contraction, wherein the expansion and contraction of the thermal sensitive means displaces said at least one tooling member relative to said means for supporting said at least one tooling member, temperature sensing means in thermal communication with said thermal sensitive means, control means in communication with said temperature sensing means and said thermal sensitive means and responsive to said temperature sensing means so as to effect the expansion and contraction of said thermal expansion means whereby said at least one tooling member is displaceable from a first position to a selected second position relative to said means for supporting said at least one tooling member.

9. An apparatus for optimizing the relationship between first and second tooling members so that said tooling members are maintained within a predetermined relationship during the operation thereof comprising:

a. thermal sensitive means disposed between said at least one tooling member and means for supporting said at least one tooling member, said thermal sensitive means being capable of thermally induced expansion and contraction, wherein the expansion and contraction of the thermal sensitive means displaces said at least one tooling member relative to said means for supporting said at least one tooling member, b. temperature sensing means in thermal communication with said thermal sensitive means, c. control means in communication with said temperature sensing means and said thermal sensitive means and responsive to said temperature sensing means so as to effect the expansion and contraction of said thermal expansion means whereby said at least one tooling member is displaceable from a first position to a selected second position relative to said means for supporting said at least one tooling member.

10. The apparatus according to claim 9 wherein the temperature sensing means is a thermal couple that is in electrical communication with said thermal control means and in physical communication with said thermal sensitive means wherein said thermal control means monitors the temperature of the thermal sensitive means and selectively effects the heating of the thermal sensitive means.

11. The apparatus according to claim 9 wherein the means for supporting said at least one tooling member includes a stationary bed and wherein the thermal sensitive means is disposed between said at least one tooling member and the stationary bed.

12. The apparatus according to claim 11 wherein the thermal sensitive means comprises a steel thermal expanding spacer in communication with a heater means wherein the generation of heat by said heater means causes said thermal spacer to expand such that the expansion of said thermal spacer displaces at least one tooling member relative to said means for supporting at least one tooling member.

13. The apparatus according to claim 9 wherein the means for supporting said at least one tooling member includes a stationary bed.

14. The apparatus according to claim 9 in combination with an apparatus for the manufacture of converted can ends.

15. A method of maintaining within a predetermined relationship first and second tooling members of the type subject to height changing tendency that takes the tooling outside of said predetermined relationship, said method comprising the steps of:

a. mounting at least one of said tooling members on a thermal sensitive means capable of thermally induced expansion and contraction, wherein the expansion and contraction of the thermal sensitive means displaces said at least one tooling member from a first position relative to said other tooling member, b. monitoring the temperature of said thermal sensitive means, c. thermally inducing the expansion and contraction of said thermal expansion means whereby said at least one tooling member is displaceable from a first position to a selected second position relative to said other tooling member.

16. In combination with a conversion press for the manufacture of products in which a reciprocating ram advances and retracts a first tooling component toward and away from a second tooling component mounted upon a stationary tooling bed, an apparatus for identifying height changes in the tooling and/or degradation of the quality of the products during the manufacturing process comprising:

(a) means for generating a first signal indicative of the an angular position of the reciprocating ram through a predetermined range of travel wherein zero degrees indicates the furthest withdrawal of the ram from the press bed and 180 degrees indicates the closest point of approach of the ram to the press bed;

(b) means for generating at least one second signal indicative of a force differential between the first tooling component and the second tooling component;

(c) means for plotting said second signal relative to said first signal for the predetermined range of travel of the reciprocating ram in order to define a value of force differential for said second signal;

(d) means for establishing preferred differential values indicative of tooling loading;

(e) means for comparing said plotted second signal to said established preferred differential values;

(f) means for generating an output signal indicative of said compared, plotted second signals at least when said plotted second signal falls beyond said established preferred differential values; and (g) means responsive to said output signal for optimizing the force differential between said first and second tooling components so that said tooling members are maintained within a predetermined relationship.

17. The combination of claim 16 including means in the stationary tooling bed for generating the second signal and means responsive to the output signal indicative of the compared, plotted second signal operatively associated with the conversion press.

18. The combination of claim 17 wherein the means in the conversion press responsive to the output signal indicative of the compared, plotted second signal further includes means for effecting the operation of the conversion press operation.

19. The combination according to claim 16 wherein the means for optimizing the relationship between first and second tooling members so that said tooling members are maintained within a predetermined relationship during the operation thereof comprises:

a. thermal sensitive means disposed between said at least one tooling member and means for supporting said at least one tooling member, said thermal sensitive means being capable of thermally induced expansion and contraction, wherein the expansion and contraction of the thermal sensitive means displaces said at least one tooling member relative to said means for supporting said at least one tooling member, b. temperature sensing means in thermal communication with said thermal sensitive means, c. control means in communication with said temperature sensing means and said thermal sensitive means and responsive to said temperature sensing means so as to effect the expansion and contraction of said thermal expansion means whereby said at least one tooling member is displaceable from a first position to a selected second position relative to said means for supporting said at least one tooling member.

20. The combination according to claim 19 wherein the temperature sensing means is a thermal couple that is in electrical communication with said thermal control means and in physical communication with said thermal sensitive means wherein said thermal control means monitors the temperature of the thermal sensitive means and selectively effects the heating of the thermal sensitive means.

21. The combination according to claim 20 wherein the means for supporting said at least one tooling member includes a stationary bed and wherein the thermal sensitive means is disposed between said at least one tooling member and the stationary bed.

22. The combination according to claim 20 wherein the thermal sensitive means comprises a steel thermal expanding spacer in communication with a heater means wherein the generation of heat by said heater means causes said thermal spacer to expand such that the expansion of said thermal spacer displaces at least one tooling member relative to said means for supporting at least one tooling member.

23. The combination according to claim 22 wherein the means for supporting said at least one tooling member includes a stationary bed.

24. The apparatus according to claim 23 in combination with an apparatus for the manufacture of converted can ends.

25. In combination with a conversion press for the manufacture of products in which a reciprocating ram advances and retracts a first tooling component toward and away from a second tooling component mounted upon a stationary tooling bed, an apparatus for identifying wear in the tooling and maintaining said first and second tooling members in a predetermined relationship relative to each other products during the manufacturing process comprising: means for generating a first signal indicative of the an angular position of the reciprocating ram through a predetermined range of travel wherein zero degrees indicates the furthest withdrawal of the ram from the press bed and 180 degrees indicates the closest point of approach of the ram to the press bed; means for generating at least one second signal indicative of a force differential between the first tooling component and the second tooling component; means for plotting said second signal relative to said first signal for the predetermined range of travel of the reciprocating ram in order to define a value of force differential for said second signal; means for establishing preferred differential values indicative of tooling load; means for comparing said plotted second signal to said established preferred differential values; means for generating an output signal indicative of said compared, plotted second signals at least when said plotted second signal falls beyond said established preferred differential values; means responsive to said output signal for effecting the relative position of the second tooling member relative to a supporting stationary base, comprising thermal sensitive means disposed between said at least one tooling member and means for supporting said at least one tooling member, said thermal sensitive means being capable of thermally induced expansion and contraction, wherein the expansion and contraction of the thermal sensitive means displaces said at least one tooling member relative to said means for supporting said at least one tooling member, temperature sensing means in thermal communication with said thermal sensitive means, control means in communication with said temperature sensing means and said thermal sensitive means and responsive to said temperature sensing means so as to effect the expansion and contraction of said thermal expansion means whereby said at least one tooling member is displaceable from a first position to a selected second position relative to said means for supporting said at least one tooling member.

* * * * *